US010175619B1

(12) United States Patent
Okuma et al.

(10) Patent No.: US 10,175,619 B1
(45) Date of Patent: Jan. 8, 2019

(54) FIXING DEVICE AND IMAGE FORMING APPARATUS

(71) Applicant: FUJI XEROX CO., LTD., Tokyo (JP)

(72) Inventors: Hiroaki Okuma, Kanagawa (JP); Masakatsu Eda, Kanagawa (JP); Sho Watanabe, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/945,794

(22) Filed: Apr. 5, 2018

(30) Foreign Application Priority Data

Jul. 10, 2017 (JP) ..... 2017-135062

(51) Int. Cl.
*G03G 15/20* (2006.01)

(52) U.S. Cl.
CPC ..... *G03G 15/2039* (2013.01); *G03G 15/2042* (2013.01); *G03G 15/2053* (2013.01)

(58) Field of Classification Search
CPC ..... G03G 15/2039; G03G 15/2042; G03G 15/2053
See application file for complete search history.

(56) References Cited

U.S. PATENT DOCUMENTS 7,187,899 B2 * 3/2007 Cao ..... G03G 15/2017 399/328
9,091,975 B2 * 7/2015 Hara ..... G03G 15/2039

FOREIGN PATENT DOCUMENTS

JP 2002-174974 A 6/2002
JP 2012-027168 A 2/2012

* cited by examiner

*Primary Examiner* — Hoang Ngo
(74) *Attorney, Agent, or Firm* — Sughrue Mion, PLLC

(57) ABSTRACT

A fixing device includes a heating member that heats a developer image on a recording medium; a controlling member that controls a surface temperature of the heating member by coming into contact with an outer circumferential surface of the heating member; a measuring member that measures, on a downstream of the controlling member and on an upstream of a pressing member in a rotation direction of the heating member, the surface temperature; and a supporting unit that causes the controlling member to come into contact with and be separated from the outer circumferential surface by rotating a supporting member around a rotation fulcrum. A distance between the rotation fulcrum and a contact position at which the controlling member comes into contact with the outer circumferential surface is longer than that between the rotation fulcrum and a measurement position at which the measuring member measures the surface temperature.

9 Claims, 11 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2017-135062 filed Jul. 10, 2017.

BACKGROUND

Technical Field

The present invention relates to a fixing device and an image forming apparatus.

SUMMARY

According to an aspect of the invention, there is provided a fixing device including a heating member that rotates around an axis thereof and that heats a developer image formed on a recording medium held by the heating member and a pressing member; a controlling member that controls a surface temperature of the heating member by coming into contact with an outer circumferential surface of the heating member; a measuring member that is positioned on a downstream side of the controlling member and on an upstream side of the pressing member in a rotation direction of the heating member and that measures the surface temperature of the heating member; and a supporting unit that causes the controlling member to come into contact with and be separated from the outer circumferential surface of the heating member by rotating a supporting member around a rotation fulcrum. A distance between the rotation fulcrum and a contact position at which the controlling member comes into contact with the outer circumferential surface of the heating member is longer than a distance between the rotation fulcrum and a measurement position at which the measuring member measures the surface temperature of the heating member.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
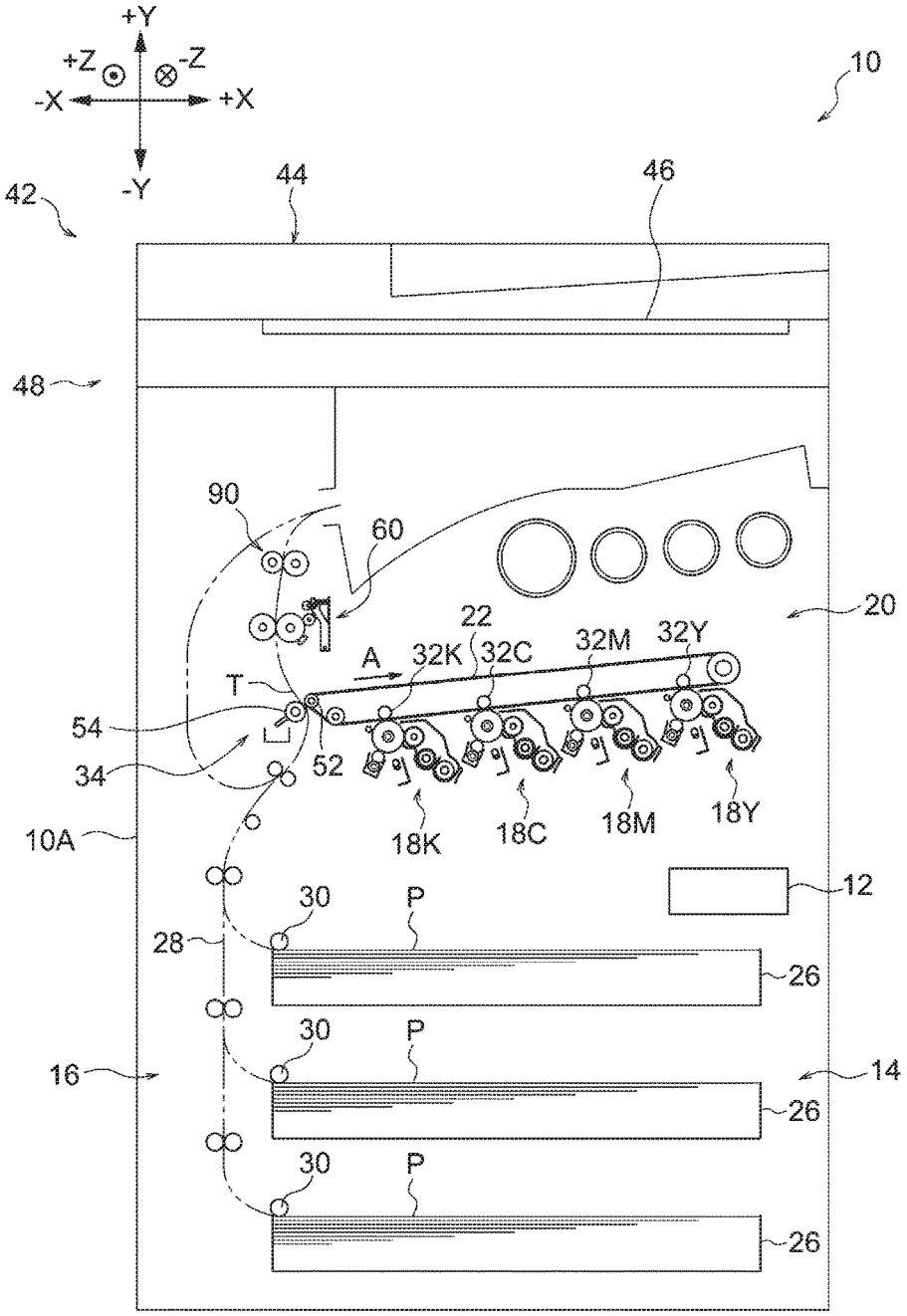
FIG. 1 is a front view of an image forming apparatus according to a first exemplary embodiment.

In the following description, an image forming apparatus 10 according to a first exemplary embodiment will be described using the directions of the image forming apparatus 10 as reference. Specifically, the width direction, the height direction, and the depth direction of the image forming apparatus 10 illustrated in FIG. 1 are referred to as an X direction, a Y direction, and a Z direction, respectively. When discrimination between one side and the other side of each of the X direction, the Y direction, and the Z direction is necessary, the right side, the left side, the upper side, the lower side, the front side, and the rear side of the image forming apparatus 10 illustrated in FIG. 1 are referred to as a +X side, a −X side, a +Y side, a −Y side, a +Z side, and a −Z side, respectively. Moreover, in the first exemplary embodiment, recording paper P is employed as an example of a recording medium. The upstream side of a transport direction in which the recording paper P is transported is referred to as a transport-direction upstream side, and the downstream side of the transport direction is referred to as a transport-direction downstream side.

Configuration of Image Forming Apparatus

As illustrated in FIG. 1, the image forming apparatus 10 includes a storage part 14 for storing the recording paper P and a transport part 16 for transporting the recording paper P stored in the storage part 14. The image forming apparatus 10 also includes an image forming part 20 for forming an image onto the recording paper P transported by the transport part 16, a document reading part 42 for reading a document, and a controller 12 for controlling each part.

The storage part 14 includes three storage members 26 that are capable of being drawn out from an image forming apparatus body 10A, which is the apparatus body of the image forming apparatus 10, toward the +Z side. Each of the three storage members 26 stores the recording paper P. Each storage member 26 includes a sending roller 30 that sends the recording paper P stored in the storage member 26 to a transport path 28 constituting the transport part 16.

The transport part 16 includes plural transport rollers that transport the recording paper P along the transport path 28, which is for transporting the recording paper P.

The document reading part 42 includes a document transport device 44 and a platen glass 46. The document transport device 44 automatically transports documents to be read one by one. The platen glass 46 is disposed on the −Y side of the document transport device 44. One sheet of the documents to be read is placed on the platen glass 46. The document reading part 42 also includes a document reading device 48 that reads each document to be read transported by the document transport device 44 or each document to be read placed on the platen glass 46.

The image forming part 20 includes four image forming units 18Y, 18M, 18C, and 18K corresponding to yellow (Y), magenta (M), cyan (C), and black (K), respectively. Note that the reference characters Y, M, C, and K will be omitted in the following description when there is no need to discriminate Y, M, C, and K from each other.

The image forming unit 18 for each color is attachable to and detachable from the image forming apparatus body 10A. Each image forming unit 18 includes a photoconductor as an image carrier and a charging member as a charging unit that charges a surface of the photoconductor. Each image forming unit 18 also includes an exposure device as an exposure unit that radiates exposure light onto the charged photoconductor and a developing device as a developing unit that develops an electrostatic latent image formed by being irradiated with the exposure light to be visible as a toner image. The toner image is an example of a developer image.

The image forming part 20 also includes a turnably attached endless transfer belt 22 and first transfer rollers 32. The first transfer rollers 32 transfer, onto the transfer belt 22, the toner images each formed by the image forming unit 18 for each color corresponding thereto.

The image forming part 20 further includes an auxiliary roller 52 and a second transfer roller 54. The transfer belt 22 is wound around the auxiliary roller 52. The second transfer roller 54 is disposed opposite (−X side) the auxiliary roller 52 with the transfer belt 22 interposed therebetween. The second transfer roller 54 transfers the toner images transferred on the transfer belt 22 onto the recording paper P. The auxiliary roller 52, the second transfer roller 54, and the transfer belt 22 constitute a transfer device 34 as a transfer unit. In addition, the image forming part 20 includes a fixing device 60 disposed on the transport-direction downstream side of the second transfer roller 54. The fixing device 60 fixes the toner images onto the recording paper P by applying heat and pressure to the recording paper P on which the toner images have been transferred. The fixing device 60 will be described later in detail.

A decurler unit 90 is disposed on the transport-direction downstream side of the fixing device 60. The decurler unit 90 includes a pair of decurler rollers 92 and 94 (refer to FIG. 2) that correct a curve, or a curl, of the recording paper P by applying pressure to the recording paper P.

Operation of Image Forming Apparatus

The image forming apparatus 10 forms an image as described below.

First, after a voltage is applied to the charging member for each color, each charging member negatively charges a surface of the photoconductor for each color corresponding thereto with a predetermined potential such that the surface is evenly negatively charged. Thereafter, the exposure device radiates the exposure light onto the charged surface of the photoconductor of each color on the basis of image data that has been read by the document reading part 42 to form electrostatic latent images. Thus, the electrostatic latent images corresponding to the data are formed on the surface of the photoconductor of each color.

The developing device for each color develops the electrostatic latent image corresponding thereto to be visible as a toner image. The toner image formed on the surface of the photoconductor of each color is sequentially transferred onto the transfer belt 22 by the first transfer roller 32 corresponding thereto. Thus, the transfer belt 22 carries the toner images on the outer circumferential surface thereof.

Here, the recording paper P that has been sent from one of the storage members 26 to the transport path 28 by the sending roller 30 corresponding thereto is sent to a transfer position T, where the transfer belt 22 and the second transfer roller 54 are in contact with each other. At the transfer position T, the recording paper P is transported between the transfer belt 22 and the second transfer roller 54, and the toner images on the outer circumferential surface of the transfer belt 22 are thereby transferred onto a surface of the recording paper P. The toner images transferred on the surface of the recording paper P are fixed to the recording paper P by the fixing device 60. The recording paper P on which the toner images are fixed is discharged to the outside of the image forming apparatus body 10A after a curl of the recording paper P is corrected by the decurler unit 90.

Components

Next, the fixing device 60 and other components according to the first exemplary embodiment will be described.

Figure 2:
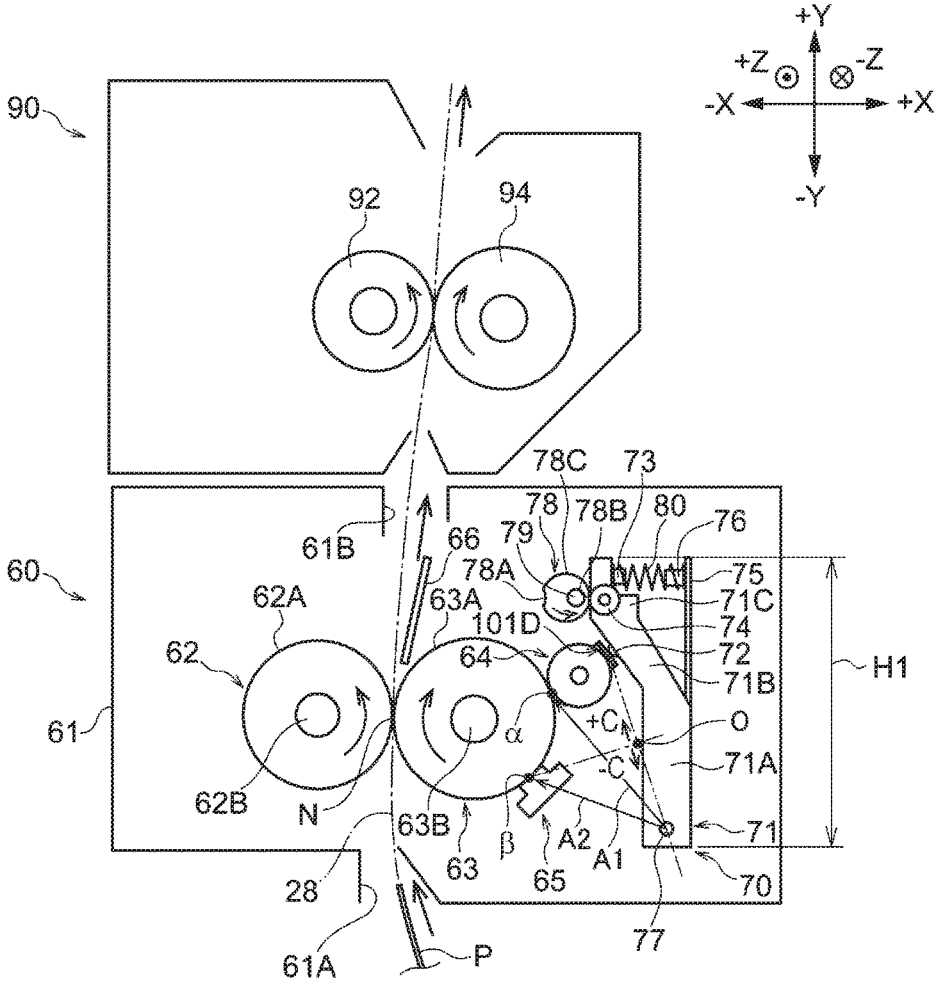
FIG. 2 is a front view of a fixing device and a decurler unit according to the first exemplary embodiment.

As illustrated in FIG. 2, the fixing device 60 includes a housing 61. The housing 61 includes an entrance part 61A through which the recording paper P enters the housing 61 and a discharge part 61B through which the recording paper P is discharged. The fixing device 60 is attachable to and detachable from the image forming apparatus body 10A.

A heating roller 63, a pressing roller 62, a temperature sensor 65, a temperature controlling roller 64, a peeling member 66, and a contact/separation mechanism 70 are attached to the housing 61.

The heating roller 63 rotates around the axis thereof and heats the toner images formed on the recording paper P that is held between the heating roller 63 and the pressing roller 62. The heating roller 63 is an example of a heating member.

The heating roller 63 is disposed along the transport path 28 on the toner image surface side (+X side) of the recording paper P. The heating roller 63 is constituted by, for example, a cylindrical core bar 63B formed of aluminum and an outer circumferential surface 63A formed of silicone rubber, the outer circumferential surface 63A covering an outer circumference of the core bar 63B. A halogen heater (not shown), which serves as a heat source, is disposed inside the core bar 63B in such a manner that the halogen heater is not in contact with an inner circumferential surface of the core bar 63B. The halogen heater is caused to generate heat by being supplied with electric power by a power source (not shown) and heats the core bar 63B to thereby heat the entire heating roller 63. Hereinafter, a direction in which the heating roller 63 rotates clockwise in a view (front view) from the +Z side is referred to as a rotation direction.

The pressing roller 62 applies pressure to the recording paper P that is held between the pressing roller 62 and the heating roller 63. The pressing roller 62 is an example of a pressing member. Here, a nip part N between the heating roller 63 and the pressing roller 62 is at approximately the 9 o'clock position of the core bar 63B in the view (front view) from the +Z side.

The pressing roller 62 is disposed in the housing 61 on the −X side of the heating roller 63. The pressing roller 62 is constituted by, for example, a cylindrical core bar 62B formed of aluminum and an outer circumferential surface 62A formed of silicone rubber, the outer circumferential surface 62A covering an outer circumference of the core bar 62B. A halogen heater (not shown), which serves as a heat source, is disposed inside the core bar 62B in such a manner that the halogen heater is not in contact with an inner circumferential surface of the core bar 62B. The halogen heater is caused to generate heat by being supplied with electric power from the power source (not shown) and heats the core bar 62B to thereby heat the entire pressing roller 62.

The temperature sensor 65 measures a surface temperature of the heating roller 63. The temperature sensor 65 is an example of a measuring member.

In the view from the +Z side (front view), as described later, the temperature sensor 65 is disposed on the rotation-direction downstream side of the temperature controlling roller 64, which is disposed at approximately the 2 o'clock position of the core bar 63B, and on the rotation-direction upstream side of the pressing roller 62 in the rotation direction of the heating roller 63. Specifically, the temperature sensor 65 is disposed at approximately the 4 o'clock position of the core bar 63B in the view from the +Z side (front view). Therefore, the temperature sensor 65 does not obstruct transport of the recording paper P because the temperature sensor 65 is disposed on the +X side of the transport path 28 so as to be spaced apart therefrom. The rotation-direction downstream side is an example of the downstream side.

Figure 3:
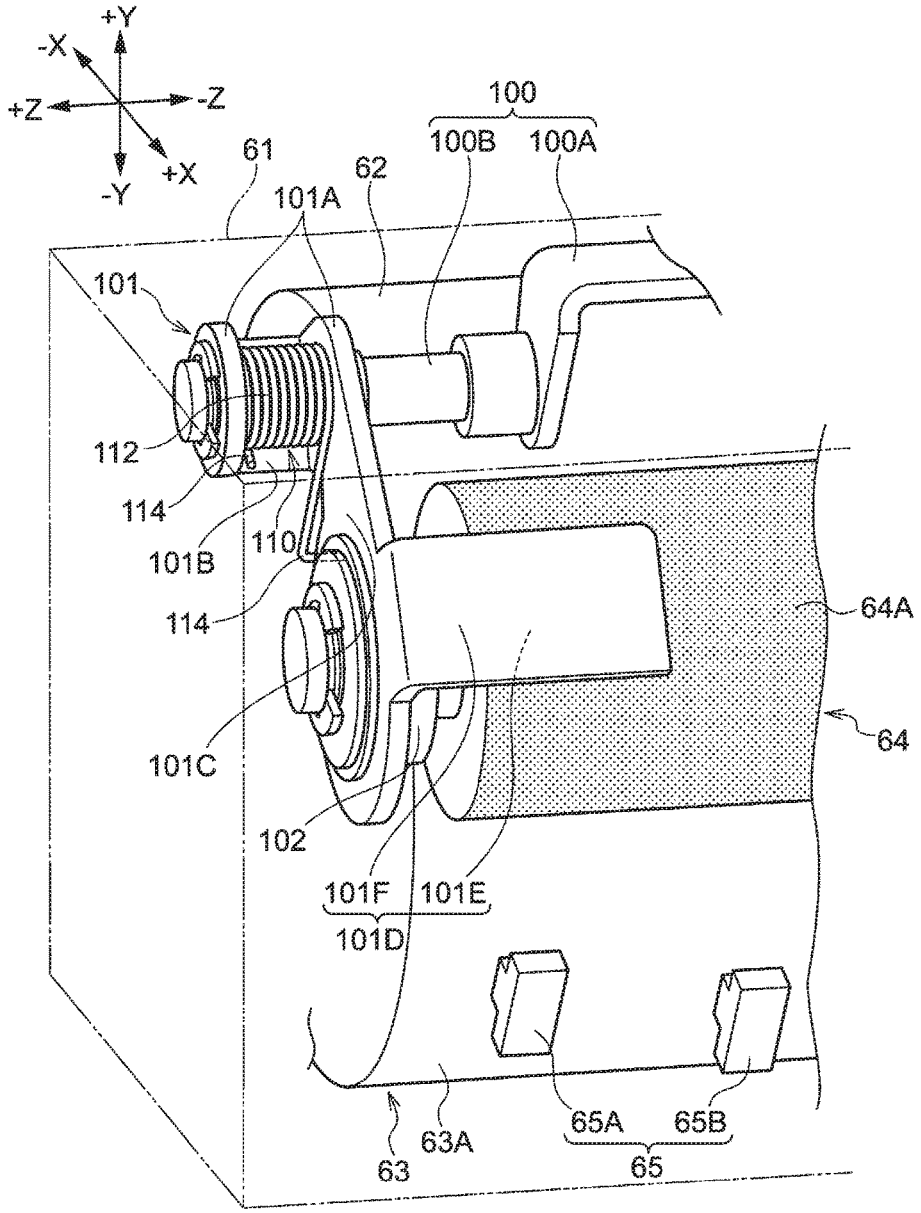
FIG. 3 is a perspective view showing a supported state of a temperature controlling roller according to the first exemplary embodiment.

In the first exemplary embodiment, a contact-type first temperature sensor 65A and a non-contact type second temperature sensor 65B are disposed as the temperature sensor 65 (refer to FIG. 3). As illustrated in FIG. 3, the first temperature sensor 65A and the second temperature sensor 65B are disposed in a region in which the temperature controlling roller 64 comes into contact with the heating roller 63 in the Z direction, that is, in an area of the temperature controlling roller 64, the area extending in the Z direction. The temperature sensor 65 may include only contact-type temperature sensors or only non-contact type temperature sensors. Moreover, the temperature sensor 65 may include three or more temperature sensors. The temperature sensor 65 is connected to the controller 12 (refer to FIG. 1). The controller 12 performs output to the halogen heaters (not shown) included in the heating roller 63 and the pressing roller 62 on the basis of an input from the temperature sensor 65.

The temperature controlling roller 64 comes into contact with the outer circumferential surface 63A of the heating roller 63 and controls the surface temperature of the heating roller 63, specifically, reduces the surface temperature of the heating roller 63. More specifically, by coming into contact with the outer circumferential surface 63A of the heating roller 63, the temperature controlling roller 64 absorbs the heat of the heating roller 63 from the heating roller 63 to thereby reduce the surface temperature of the heating roller 63. The temperature controlling roller 64 is an example of a controlling member.

The temperature controlling roller 64 is, for example, an aluminum pipe. The temperature controlling roller 64 is disposed on the rotation-direction upstream side of the temperature sensor 65 and on the rotation-direction downstream side of the pressing roller 62 in the rotation direction of the heating roller 63 (refer to FIG. 2). Specifically, the temperature controlling roller 64 is disposed at approximately the 2 o'clock position of the core bar 63B in the view from the +Z side (front view).

The temperature controlling roller 64 is caused to come into contact with and be separated from the outer circumferential surface 63A of the heating roller 63 by the operation of the contact/separation mechanism 70, which will be described later. The temperature controlling roller 64 comes into contact with the outer circumferential surface 63A of the heating roller 63 by being pushed in a direction toward the outer circumferential surface 63A by a pressed portion 101D that has been pushed by a pressing portion 72 of the contact/separation mechanism 70. The pressing portion 72 and the pressed portion 101D will be described later. The temperature controlling roller 64 is caused to be separated from the outer circumferential surface 63A of the heating roller 63 by a rotating portion 101 that is raised in a direction away from the outer circumferential surface 63A due to an urging force of an elastic member 110 (refer to FIG. 3). The rotating portion 101 and the elastic member 110 will be described later.

A configuration in which the temperature controlling roller 64 is supported by the housing 61 and raised in the direction away from the outer circumferential surface 63A of the heating roller 63 due to the urging force of the elastic member 110 (refer to FIG. 3) will be specifically described below.

As illustrated in FIG. 3, a fixing member 100 is fixed to the housing 61. The fixing member 100 includes a fixing plate 100A and a circular-cylindrical cylinder portion 100B. The fixing plate 100A is substantially L-shaped in the view from the +X side (right side view) and is fixed to the housing 61. The cylinder portion 100B extends from a +Z-side end of the fixing plate 100A toward the +Z side.

The cylinder portion 100B supports the rotating portion 101 and the elastic member 110. The rotating portion 101 is rotatable around the axis of the cylinder portion 100B. The elastic member 110 is, for example, a torsion spring.

The rotating portion 101 includes a pair of surrounding portions 101A, a spring receiving portion 101B, an extending portion 101C, and the pressed portion 101D. The pair of surrounding portions 101A surround the cylinder portion 100B. The spring receiving portion 101B is bridged between the pair of surrounding portions 101A. The extending portion 101C extends from the −Z side of the surrounding portions 101A toward the +X side. The pressed portion 101D extends from the extending portion 101C toward the −Z side.

The pressed portion 101D extends from the extending portion 101C towards the −Z side so as to reach a position where the pressed portion 101D overlaps the temperature controlling roller 64 in the Z direction. In other words, the pressed portion 101D is positioned within the area of the temperature controlling roller 64, the area extending in the Z direction. Here, the pressed portion 101D has a facing surface 101E and a pressed surface 101F. The facing surface 101E is a surface that faces the temperature controlling roller 64. The pressed surface 101F is a surface opposite to the facing surface 101E. When the pressed surface 101F of the pressed portion 101D is pressed by the pressing portion 72, which will be described later, of the contact/separation mechanism 70, the facing surface 101E of the pressed portion 101D presses the temperature controlling roller 64 in a direction toward the outer circumferential surface 63A of the heating roller 63.

A bearing 102 is attached to a −Z-side surface of the extending portion 101C. The temperature controlling roller 64 is rotatably supported by the bearing 102.

The elastic member 110 is positioned between the pair of surrounding portions 101A and includes a coil portion 112 and two arm portions 114. The coil portion 112 surrounds the cylinder portion 100B. Each arm portion 114 extends from the coil portion 112. One of the arm portions 114 is in contact with the spring receiving portion 101B and the other arm portion 114 is in contact with the −X side of the extending portion 101C.

The configuration (not shown) of the −Z side of the housing 61 is similar (symmetrical) to the aforementioned configuration of the +Z side of the housing 61. While one of the arm portions 114 is in contact with the spring receiving portion 101B and the other arm portion 114 is in contact with the extending portion 101C, the elastic member 110 has an urging force that raises the rotating portion 101 in a direction rotating counter-clockwise in the view from the +Z side (front view). Thus, the temperature controlling roller 64 is caused to be raised in a direction in which the temperature controlling roller 64 is separated from the outer circumferential surface 63A of the heating roller 63 by the rotating portion 101 that has been raised by the elastic member 110.

The temperature controlling roller 64 includes a rubbing portion 64A that is formed on the outer circumferential surface thereof. The rubbing portion 64A controls the surface roughness of the outer circumferential surface 63A of the heating roller 63 by rubbing the outer circumferential surface 63A. The rubbing portion 64A is formed by, for example, roughening the outer circumferential surface of the temperature controlling roller 64 by abrasive blasting, in which particles are blasted onto the outer circumferential surface in a dry manner. The rubbing portion 64A is formed in, for example, the entire area of the outer circumferential surface of the temperature controlling roller 64. The rubbing portion 64A is not necessarily formed in the entire area of the outer circumferential surface of the temperature controlling roller 64, provided that the Z-direction length of the rubbing portion 64A is equal to or more than the maximum width of the recording paper P, that is, the Z-direction length of the recording paper P. The rubbing portion 64A is not necessarily formed by abrasive blasting and may be formed by using a publicly known roughening technique. For example, the rubbing portion 64A may be formed by bringing the outer circumferential surface of the temperature controlling roller 64 into close contact with abrasive grains to roughen the outer circumferential surface.

Thus, it may be possible to control the surface roughness of the outer circumferential surface 63A by rubbing the outer circumferential surface 63A with the rubbing portion 64A of the temperature controlling roller 64.

As illustrated in FIG. 2, the peeling member 66 is disposed, as an assisting member that assists peeling of the recording paper P, on the transport-direction downstream side of the nip part N in the housing 61.

The contact/separation mechanism 70 rotates a lever 71 around a shaft portion 77 to cause the temperature controlling roller 64 to come into contact with or be separated from the outer circumferential surface 63A of the heating roller 63. The lever 71 will be described later. The contact/separation mechanism 70, the lever 71, and the shaft portion 77 are an example of a supporting unit, an example of a supporting member, and an example of a rotation fulcrum, respectively. The contact/separation mechanism 70 includes the lever 71 formed of a sheet metal, a cam follower 74, a cam 78, and a motor (not shown) as an example of a driving unit.

The lever 71 includes a first lever portion 71A, a second lever portion 71B, and a third lever portion 71C. The first lever portion 71A extends toward the +Y side and includes the shaft portion 77. The second lever portion 71B is bent at a +Y-side end of the first lever portion 71A and extends toward the +Y side and −X side. The third lever portion 71C is bent at a +Y-side end of the second lever portion 71B and extends toward the +Y side.

The first lever portion 71A is supported by the housing 61 via a bracket (not shown). The first lever portion 71A includes the shaft portion 77. The axial direction (Z direction) of the shaft portion 77 extends in the axial direction (Z direction) of the heating roller 63. Note that the positional relationship among the shaft portion 77, the temperature controlling roller 64, and the temperature sensor 65 in the fixing device 60 will be described later.

The pressing portion 72 projecting toward the −X side is disposed on a surface of the second lever portion 71B, the surface being on the side (−X side) facing the temperature controlling roller 64. The pressing portion 72 serves as a contact point at which the lever 71 presses the pressed surface 101F of the pressed portion 101D.

The cam follower 74, which is operated by the cam 78, is rotatably attached to the third lever portion 71C. A spring receiving portion 73 for supporting one end of an elastic member 80 is disposed at a +Y-side end of the third lever portion 71C.

Here, the elastic member 80 is, for example, a coil spring. The one end of the elastic member 80 is supported by the spring receiving portion 73 of the third lever portion 71C. The other end of the elastic member 80 is fixed to a spring receiving portion 76 that is disposed on an extending plate 75 secured at a fixed position in the housing 61. The spring receiving portion 73 and the spring receiving portion 76 are positioned so as to face each other in the X direction. Thus, the elastic member 80 applies, to the lever 71, an urging force toward the −X side, that is, in a direction in which the temperature controlling roller 64 approaches the outer circumferential surface 63A of the heating roller 63.

The cam 78 rotates to come into contact with the cam follower 74 attached to the third lever portion 71C and thereby causes the temperature controlling roller 64 to come into contact with or be separated from the outer circumferential surface 63A of the heating roller 63. In other words, the cam 78 reciprocates the lever 71 in a direction in which the temperature controlling roller 64 approaches the outer circumferential surface 63A of the heating roller 63 and in a direction in which the temperature controlling roller 64 is separated from the outer circumferential surface 63A.

The cam 78 is, for example, a substantially circular eccentric cam that is disposed so as to be rotatable around a rotary shaft 79. The cam 78 includes a recessed portion 78A that is disposed at a portion of the outer circumference thereof having maximum eccentricity. The recessed portion 78A has a curvature corresponding to the curvature of the cam follower 74. A portion of an outer circumferential surface of the cam 78 opposite to the recessed portion 78A is an outer circumferential portion 78B. A portion of the outer circumferential surface of the cam 78 between the outer circumferential portion 78B and the recessed portion 78A is an outer circumferential portion 78C.

The cam 78 is rotated counter-clockwise in the view (front view) from the +Z side by a driving force of the motor (not shown). The cam 78 is rotatable while being in contact with the cam follower 74 due to the lever 71 being urged toward the −X side by the elastic member 80.

Here, the cam 78 is stopped by the motor (not shown) at a first position where the temperature controlling roller 64 comes into contact with the outer circumferential surface 63A of the heating roller 63, a second position where the temperature controlling roller 64 is separated from the outer circumferential surface 63A of the heating roller 63, and a third position between the first position and the second position.

The first position is a position at which the outer circumferential portion 78B is in contact with the cam follower 74. The second position is a position at which the recessed portion 78A is in contact with the cam follower 74. The third position is a position at which the outer circumferential portion 78C is in contact with the cam follower 74.

Figure 4:
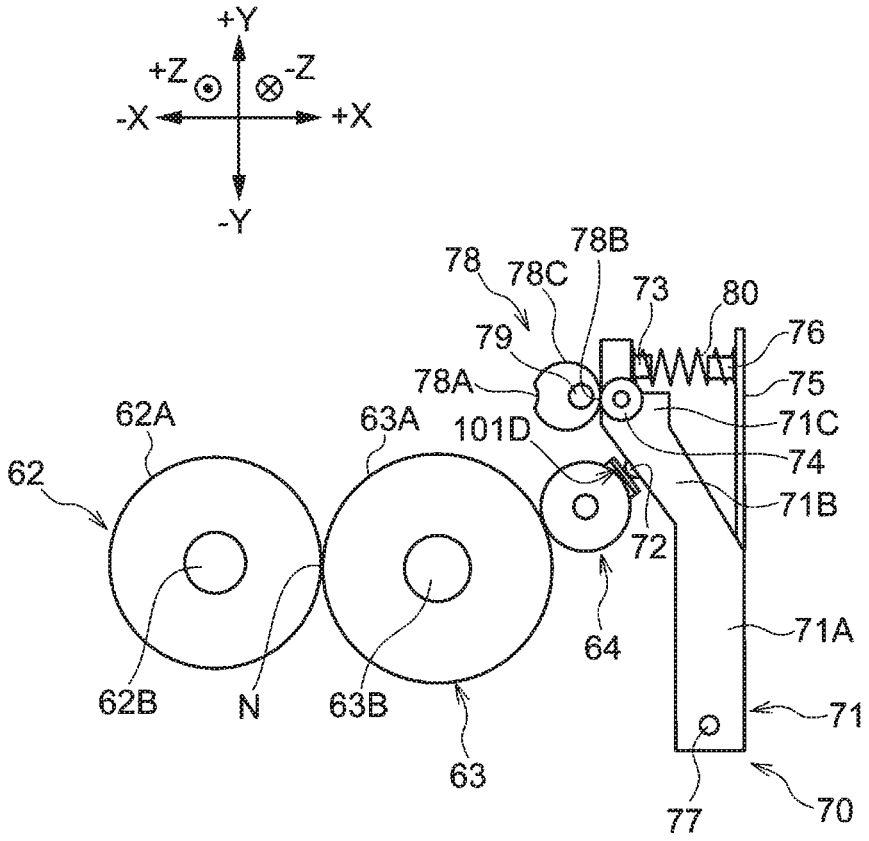
FIG. 4 is a front view showing a full-latch state according to the first exemplary embodiment.

As illustrated in FIG. 4, while the cam 78 is stopped at the first position, and the outer circumferential portion 78B and the cam follower 74 are in contact with each other, the temperature controlling roller 64 is in contact with the outer circumferential surface 63A of the heating roller 63.

Figure 5:
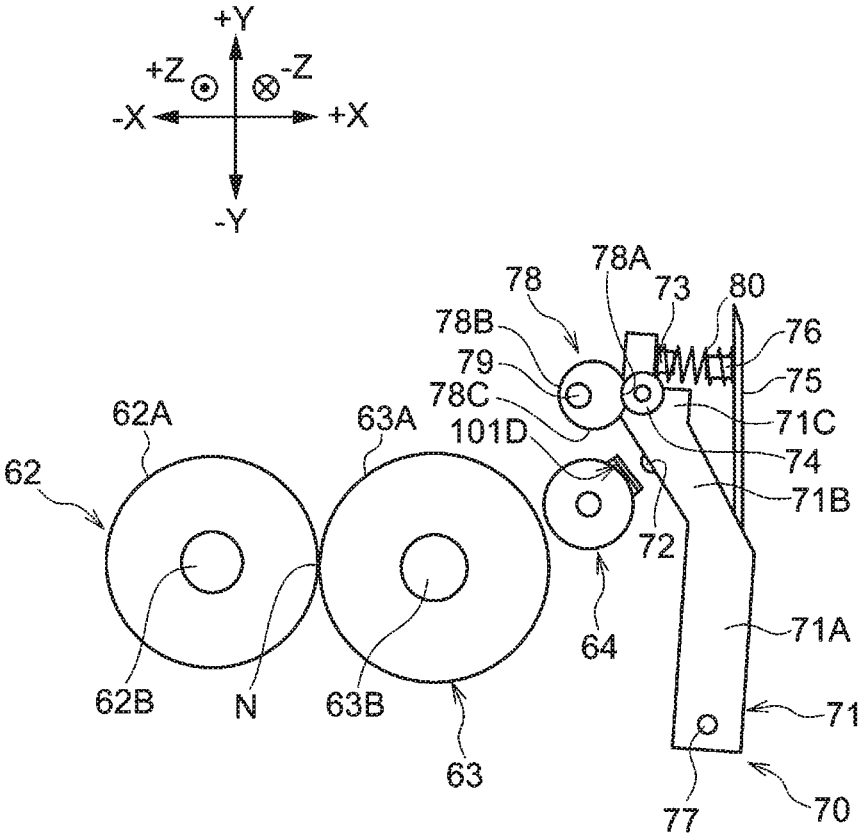
FIG. 5 is a front view showing a latch-release state according to the first exemplary embodiment.

As illustrated in FIG. 5, while the cam 78 is stopped at the second position, and the recessed portion 78A and the cam follower 74 are in contact with each other, the temperature controlling roller 64 is separated from the outer circumferential surface 63A of the heating roller 63.

Figure 6:
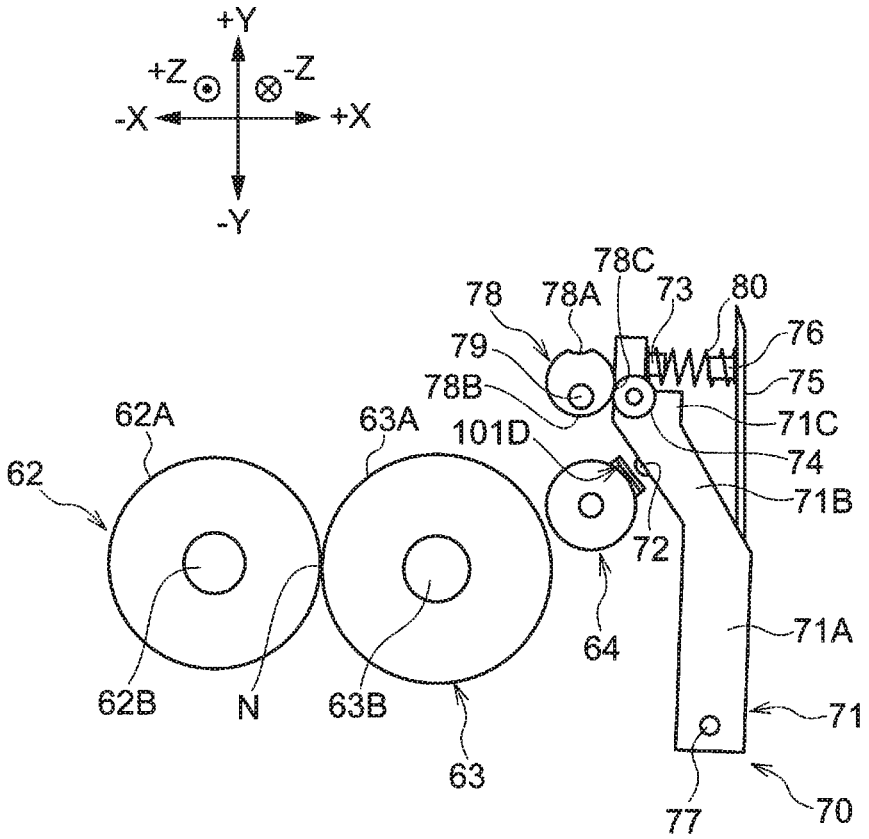
FIG. 6 is a front view showing a half-latch state according to the first exemplary embodiment.

As illustrated in FIG. 6, while the cam 78 is stopped at the third position, and the outer circumferential portion 78C and the cam follower 74 are in contact with each other, the temperature controlling roller 64 is separated from the outer circumferential surface 63A of the heating roller 63. Note that a separation distance by which the pressed portion 101D and the pressing portion 72 are spaced apart from each other is short when the outer circumferential portion 78C and the cam follower 74 are in contact with each other compared with the distance therebetween when the recessed portion 78A and the cam follower 74 are in contact with each other.

Hereinafter, a state in which the outer circumferential portion 78B and the cam follower 74 are in contact with each other due to the cam 78 stopping at the first position, and the temperature controlling roller 64 is thus in contact with the outer circumferential surface 63A of the heating roller 63 is referred to as a full-latch state (refer to FIG. 4); a state in which the recessed portion 78A and the cam follower 74 are in contact with each other due to the cam 78 stopping at the second position, and the temperature controlling roller 64 is thus separated from the outer circumferential surface 63A of the heating roller 63 is referred to as a latch-release state (refer to FIG. 5); and a state in which the outer circumferential portion 78C and the cam follower 74 are in contact with each other due to the cam 78 stopping at the third position, and the temperature controlling roller 64 is thus separated from the outer circumferential surface 63A of the heating roller 63 is referred to as a half-latch state (refer to FIG. 6). Note that, as described above, the separation distance by which the pressed portion 101D and the pressing portion 72 are spaced apart from each other is short in the half-latch state compared with the separation distance in the latch-release state. In other words, the pressing portion 72 is considerably close to the pressed portion 101D in the half-latch state.

Positional Relationship in Fixing Device

Next, the positional relationship in the fixing device 60 will be described. Note that hereinafter, a position at which the temperature controlling roller 64 comes into contact with the outer circumferential surface 63A of the heating roller 63 is referred to as a contact position α, and a position at which the temperature sensor 65 measures the surface temperature of the heating roller 63 is referred to as a measurement position β. An example of the measurement position β (refer to FIG. 2) is a position at which the first temperature sensor 65A comes into contact with the outer circumferential surface 63A. Note that when the temperature controlling roller 64 and the outer circumferential surface 63A are in contact with each other with a nip width therebetween, the contact position α is a center portion of the nip width.

Here, as illustrated in FIG. 2, the temperature controlling roller 64 and the temperature sensor 65 are disposed in the fixing device 60 according to the first exemplary embodiment in such a manner that a distance (hereinafter referred to as a distance A1) between the center of the shaft portion 77 and the contact position α is longer than a distance (hereinafter referred to as a distance A2) between the center of the shaft portion 77 and the measurement position β.

In the fixing device 60, the shaft portion 77 is disposed at a position spaced apart from the contact position α and opposite the contact position α with respect to the measurement position β in an intersection direction (hereinafter referred to as a C direction) intersecting the axial direction (Z direction) of the heating roller 63. Here, the C direction is a direction passing through the contact point between the pressed portion 101D and the pressing portion 72 and passing through the center of the shaft portion 77. Note that the C direction is an example of the intersection direction. A starting point O (refer to FIG. 2) is an intersection point of the C direction and a line that is perpendicular to the C direction and that passes through the measurement position β. When the starting point O is used as reference, a side extending from the starting point O toward the contact point between the pressed portion 101D and the pressing portion 72 is referred to as a +C side, and a side opposite to the +C side is referred to as a −C side.

As illustrated in FIG. 2, in the fixing device 60 according to the first exemplary embodiment, the contact position α is positioned on the +C side of the measurement position β in the C direction, and the shaft portion 77 is positioned on the −C side of the measurement position β in the C direction. In others words, the shaft portion 77 is disposed at a position spaced apart from the contact position α and opposite (−C side) the contact position α with respect to the measurement position β in a view (right side view) in a perpendicular direction that is perpendicular to the C direction and that extends in the radial direction of the shaft portion 77.

Operation

When the controller 12 issues a print command, the image forming apparatus 10 changes from the latch-release state to the half-latch state. In other words, when the controller 12 issues the print command, the pressing portion 72 is on standby in a state in which the pressing portion 72 is considerably close to the pressed portion 101D. When the recording paper P is developed on the basis of the print command issued by the controller 12, the image forming apparatus 10 changes from the half-latch state to the full-latch state in accordance with a position of a leading end of the recording paper P after the entire heating roller 63 is heated by the halogen heater (not shown) and before the recording paper P enters the nip part N. In other words, the temperature controlling roller 64 comes into contact with the outer circumferential surface 63A of the heating roller 63. The image forming apparatus 10 changes from the full-latch state to the latch-release state when the heating roller 63 has rotated once since the temperature controlling roller 64 has come into contact with the outer circumferential surface 63A. In other words, the temperature controlling roller 64 is separated from the outer circumferential surface 63A of the heating roller 63. Thereafter, when the controller 12 issues a next print command, the image forming apparatus 10 changes from the latch-release state to the half-latch state, and the pressing portion 72 is on standby in the state in which the pressing portion 72 is considerably close to the pressed portion 101D.

As described above, the image forming apparatus 10 enters the full-latch state after the entire heating roller 63 is heated by the halogen heater (not shown) and before the recording paper P enters the nip part N, and the image forming apparatus 10 enters the latch-release state when the heating roller 63 has rotated once since the temperature controlling roller 64 has come into contact with the outer circumferential surface 63A. In other words, the image forming apparatus 10 enters the full-latch state at the timing described above, thereby causing the temperature controlling roller 64 to come into contact with the outer circumferential surface 63A of the heating roller 63 so that the surface temperature of the heating roller 63 when the heating roller 63 comes into contact with the recording paper P during a first rotation is reduced.

Therefore, according to the first exemplary embodiment, even when the surface temperature of the heating roller 63 is higher than an appropriate temperature due to being heated by the halogen heater (not shown) when the heating roller 63 comes into contact with the recording paper P during the first rotation, it may be possible to cause the heating roller 63 to come into contact with the recording paper P after the surface temperature is reduced. The surface of the heating roller 63 in second and following rotations has a reduced temperature due to the contact with a portion of the recording paper P that has been subjected to fixing in a previous rotation. In other words, the surface temperature of the heating roller 63 in each of the second and following rotations is reduced without the contact between the temperature controlling roller 64 and the outer circumferential surface 63A of the heating roller 63. Therefore, in the first exemplary embodiment, the temperature controlling roller 64 is not caused to come into contact with the outer circumferential surface 63A during each of the second and following rotations of the heating roller 63. The surface temperature of the heating roller 63 during the first rotation after the contact with the temperature controlling roller 64 is substantially equal to the surface temperature of the heating roller 63 during each of the second and following rotations.

Thus, according to the aforementioned image forming apparatus 10, it may be possible to reduce, compared with a configuration without the temperature controlling roller 64, a difference between the first rotation and each of the second and following rotations in terms of the surface temperature of the heating roller 63 when the heating roller 63 comes into contact with the recording paper P. Therefore, according to the image forming apparatus 10, gloss unevenness in the formed toner images may be reduced compared with the configuration without the temperature controlling roller 64, and thus, it may be possible to reduce gloss unevenness of the toner images after the fixing performed by the fixing device 60.

The temperature sensor 65 is disposed (refer to FIG. 2) on the rotation-direction downstream side of the temperature controlling roller 64 and on the rotation-direction upstream side of the pressing roller 62 in the rotation direction of the heating roller 63. In other words, according to the temperature sensor 65, it may be possible to measure the surface temperature of the heating roller 63 after the surface temperature is controlled by the temperature controlling roller 64.

The temperature sensor 65 is disposed (refer to FIG. 3), in the Z direction, in a region in which the temperature controlling roller 64 comes into contact with the heating roller 63, that is, in the area of the temperature controlling roller 64, the area extending in the Z direction. Thus, according to the first exemplary embodiment, it may be possible to measure the surface temperature of the heating roller 63, after the surface temperature is controlled by the temperature controlling roller 64, accurately compared with a configuration in which the temperature sensor 65 is disposed outside the Z-direction area of the temperature controlling roller 64.

The temperature controlling roller 64 includes the rubbing portion 64A formed on the outer circumferential surface thereof (refer to FIG. 3). The rubbing portion 64A controls the surface roughness of the outer circumferential surface 63A of the heating roller 63 by rubbing the outer circumferential surface 63A. The temperature controlling roller 64 is configured, for example, to enter the full-latch state after printing of a predetermined number of sheets of the recording paper P has been completed and to control the surface roughness of the outer circumferential surface 63A by rubbing the outer circumferential surface 63A with use of the rubbing portion 64A. Thus, according to the first exemplary embodiment, it may be possible to use the temperature controlling roller 64 to control the surface roughness of the outer circumferential surface 63A of the heating roller 63 in addition to controlling the surface temperature of the heating roller 63.

The rubbing portion 64A has the width equal to or more than the maximum width of the recording paper P. Thus, according to the first exemplary embodiment, it may be possible, compared with a configuration in which the width of the rubbing portion 64A is less than the maximum width of the recording paper P, to evenly control the surface roughness of a contact area of the outer circumferential surface 63A of the heating roller 63, the contact area being an area that comes into contact with the recording paper P. Therefore, according to the first exemplary embodiment, it may be possible to reduce, compared with the configuration in which the width of the rubbing portion 64A is less then the maximum width of the recording paper P, gloss unevenness in the formed toner images, and thus it may be possible to reduce gloss unevenness in the toner images fixed by the fixing device 60.

Figure 7:
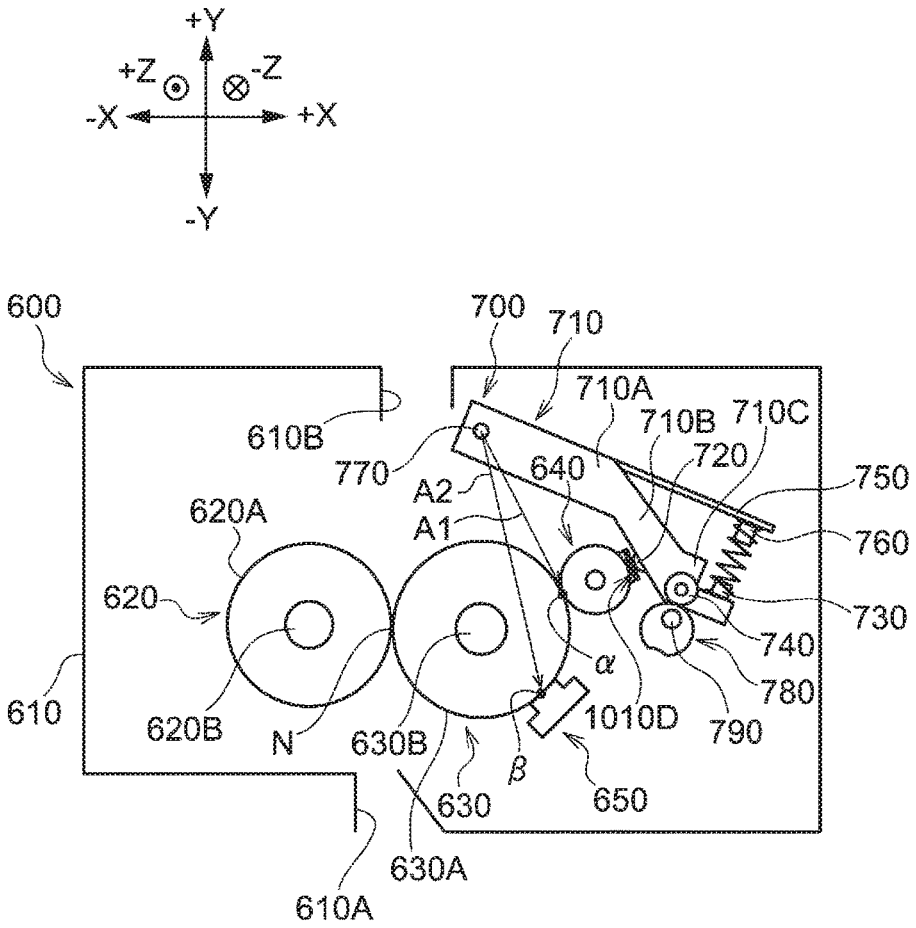
FIG. 7 is a front view of a fixing device according to a first comparative example.
Figure 8:
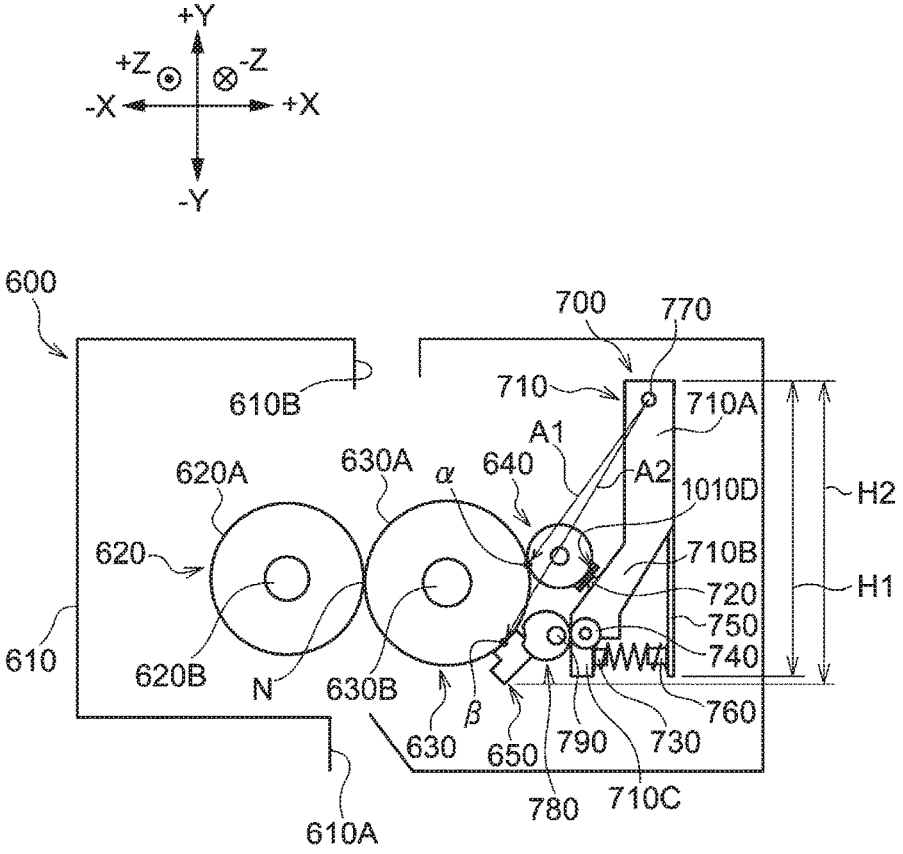
FIG. 8 is a front view of a fixing device according to a second comparative example.

Here, a fixing device 600 will be described as a comparative example of the fixing device 60 according to the first exemplary embodiment. FIG. 7 illustrates the fixing device 600 in a first comparative example and FIG. 8 illustrates the fixing device 600 in a second comparative example. The fixing device 600 according to each comparative example differs from the fixing device 60 according to the first exemplary embodiment in that a temperature controlling roller 640 and a temperature sensor 650 are disposed in such a manner that the distance A1 is shorter than the distance A2.

As illustrated in FIG. 7, a shaft portion 770 of a lever 710 according to the first comparative example is disposed on the +Y side of a heating roller 630, and a first lever portion 710A, a second lever portion 710B, and a third lever portion 710C extend from the shaft portion 770 toward the +X side. In other words, the lever 710 according to the first comparative example is disposed so as to cover, from the +Y side, the heating roller 630 and the temperature controlling roller 640.

Here, in contrast to the first comparative example, the lever 71 of the fixing device 60 according to the first exemplary embodiment does not obstruct the transport of the recording paper P because the fixing device 60 is disposed so as to extend in the Y direction. Thus, according to the first exemplary embodiment, it may be possible, even when the contact/separation mechanism 70 is disposed, to dispose the peeling member 66 on the transport-direction downstream side of the nip part N and to dispose the decurler unit 90 on the +Y side of the fixing device 60 (refer to FIG. 2).

Here, when a contact/separation mechanism 700 of the fixing device 600 according to the first comparative example is rotated clockwise in the view from the +Z side (front view), the Y-direction length of the contact/separation mechanism 700 in a housing 610 becomes longer than the length thereof illustrated in FIG. 7. Thus, for example, it is supposed that the contact/separation mechanism 700 projects from the housing 610 or that the housing 610 has a longer length in the Y direction in order to house the contact/separation mechanism 700 therein. Moreover, a decurler unit 900 (not illustrated in FIG. 7) is disposed on the +Y side of the fixing device 600; thus, it is not desirable that the contact/separation mechanism 700 projects from the housing 610. In addition, an increase in the Y-direction length of the housing 610 is not desirable from a point of view of space restriction in the image forming apparatus 10. In other words, according to the first exemplary embodiment, it may be possible to reduce, compared with the first comparative example, a space required to dispose the fixing device 60 in the image forming apparatus 10. Therefore, according to the first exemplary embodiment, the decurler unit 90 may be disposed on the transport-direction downstream side of the fixing device 60 without occupying the space in the image forming apparatus 10 compared with the first comparative example.

As illustrated in FIG. 8, the shaft portion 770 of the lever 710 according to the second comparative example is disposed on the +Y side of the heating roller 630, and the first lever portion 710A, the second lever portion 710B, and the third lever portion 710C extend from the shaft portion 770 toward the −Y side. In other words, the lever 710 according to the second comparative example is disposed in a state reversed in the Y direction relative to the lever 71 according to the first exemplary embodiment.

Here, a distance between the −Y-side end and the +Y-side end of the contact/separation mechanism 70 illustrated in FIG. 2 and a distance between the −Y-side end and the +Y-side end of the contact/separation mechanism 700 illustrated in FIG. 8 are each referred to as a distance H1; and a distance between the −Y-side end of the temperature sensor 650 illustrated in FIG. 8 and the +Y-side end of the contact/separation mechanism 700 is referred to as a distance H2.

The distance A1 is shorter than the distance A2 in the fixing device 600 according to the third comparative example while the distance A1 is longer than the distance A2 in the fixing device 60 according to the first exemplary embodiment. The distance H1 is shorter (refer to FIG. 8) than the distance H2 in the second comparative example. In other words, compared with the second comparative example, in which the distance A1 is shorter than the distance A2, a distance between a portion (lowermost end) positioned most downstream in the −Y direction of a member disposed in the housing 61 and the +Y-side end of the contact/separation mechanism 70 is short in the first exemplary embodiment, in which the distance A1 is longer than the distance A2. Thus, the contact/separation mechanism 70 does not project from the +Y-side end of the housing 61 even when the Y-direction length of the housing 61 is shortened in the first exemplary embodiment compared with the second comparative example. Therefore, according to the first exemplary embodiment, the fixing device 60 may be disposed in the image forming apparatus 10 without occupying the space in the image forming apparatus 10 in the Y direction because the Y-direction length of the fixing device 60 may be reduced compared with the second comparative example.

Moreover, a direction in which a pressing portion 720 presses a pressed portion 1010D differs from a direction in which the temperature controlling roller 640 approaches an outer circumferential surface 630A of the heating roller 630 in the fixing device 600 according to the second comparative example. Thus, compared with the fixing device 60 according to the first exemplary embodiment, a force that presses the temperature controlling roller 640 against the outer circumferential surface 630A of the heating roller 630 is weak in the fixing device 600 according to the second comparative example.

The fixing device 60 according to the first exemplary embodiment is capable of stopping the cam 78 at the third position by using the driving force of the motor (not shown). As illustrated in FIG. 6, the cam 78 stopping at the third position causes the half-latch state, in which the pressing portion 72 is considerably close to the pressed portion 101D.

Compared with the latch-release state (refer to FIG. 5), the separation distance by which the pressing portion 72 and the pressed portion 101D are spaced apart from each other is short in the half-latch state. Thus, compared with the latch-release state, which is caused by the cam 78 stopping at the second position, a time required to cause the full-latch state by moving the cam 78 to the first position may be short in the half-latch state, which is caused by the cam 78 stopping at the third position. In other words, compared with the latch-release state, a time required for the temperature controlling roller 64 to come into contact with the outer circumferential surface 63A of the heating roller 63 may be short in the half-latch state. Thus, the full-latch state may be caused at a timing when the recording paper P enters the nip part N by causing the half-latch state before the controller 12 issues a print command.

Therefore, compared with a configuration in which the cam 78 is stopped at only the first position and the second position, it may be possible to cause the temperature controlling roller 64 to rapidly come into contact with the outer circumferential surface 63A of the heating roller 63 in the fixing device 60 according to the first exemplary embodiment.

Moreover, the shaft portion 77 of the fixing device 60 according to the first exemplary embodiment is disposed (refer to FIG. 2) at the position spaced apart from the contact position α and opposite (−C side) the contact position α with respect to the measurement position β in the C direction. Therefore, compared with a configuration in which the shaft portion 77 is positioned on the contact position α side (+C side) of the measurement position β, it may be possible to cause the temperature controlling roller 64 to come into contact with the outer circumferential surface 63A of the heating roller 63 with increased accuracy in the fixing device 60 according to the first exemplary embodiment.

The aforementioned circumstances will be described by comparing with the fixing device 600 according to a third comparative example illustrated in FIG. 9. Here, when a starting point S shown in FIG. 9 is used as a reference, a side of the C direction extending from the starting point S toward the contact point between the pressed portion 101D and the pressing portion 72 is referred to as the +C side, and a side opposite to the +C side is referred to as the −C side in the third comparative example.

Figure 9:
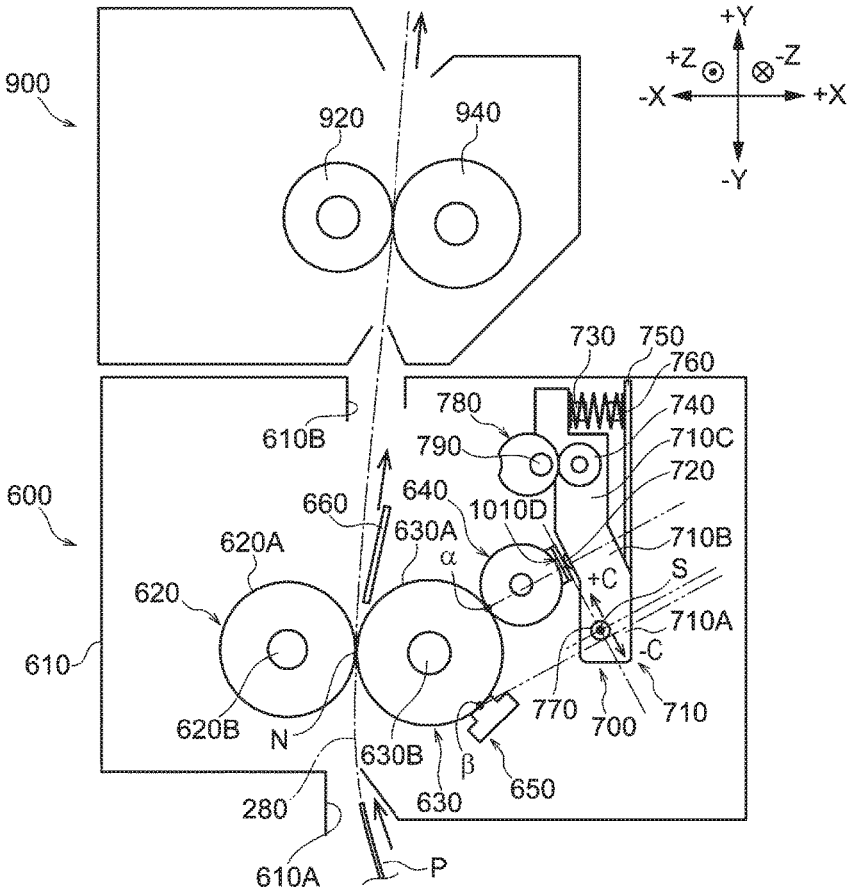
FIG. 9 is a front view of a fixing device according to a third comparative example.

As illustrated in FIG. 9, the shaft portion 770 of the fixing device 600 according to the third comparative example is disposed on the contact point α side (+C side) of the measurement position β in the C direction. The measurement position β is positioned on the −C side of the starting point S in the C direction, that is, the −C side of the shaft portion 770 in the fixing device 600 according to the third comparative example. In other words, the shaft portion 770 is disposed between the contact position α and the measurement position β, that is, on the contact position α side (+C side) of the measurement position β.

Thus, compared with the fixing device 60 according to the first exemplary embodiment, a distance between the shaft portion 770 and a rotary shaft 790 is short in the fixing device 600 according to the third comparative example. In other words, compared with the fixing device 600 according to the third comparative example, a distance between the shaft portion 77 and the rotary shaft 79 is short in the fixing device 60 according to the first exemplary embodiment.

Thus, compared with the fixing device 600 according to the third comparative example, angle variation of the lever 71 relative to the displacement of the cam 78 when the pressed portion 101D is moved by the same movement amount as that in the third comparative example is smaller in the fixing device 60 according to the first exemplary embodiment. Therefore, compared with the fixing device 600 according to the third comparative example, the influence of attachment accuracy and dimension accuracy of the cam 78 is small, and thus it may be possible to cause the temperature controlling roller 64 to come into contact with the outer circumferential surface 63A of the heating roller 63 with increased accuracy in the fixing device 60. Therefore, compared with the fixing device 600 according to the third comparative example, it may be possible to accurately cause the half-latch state, in which the pressing portion 72 is considerably close to the pressed portion 101D, by stopping the cam 78 at the third position in the fixing device 60.

Modification of First Exemplary Embodiment

A modification (hereinafter referred to as the present modification) of the first exemplary embodiment will be described below with reference to FIG. 10. In the description, features overlapping those in the first exemplary embodiment will be omitted.

Figure 10:
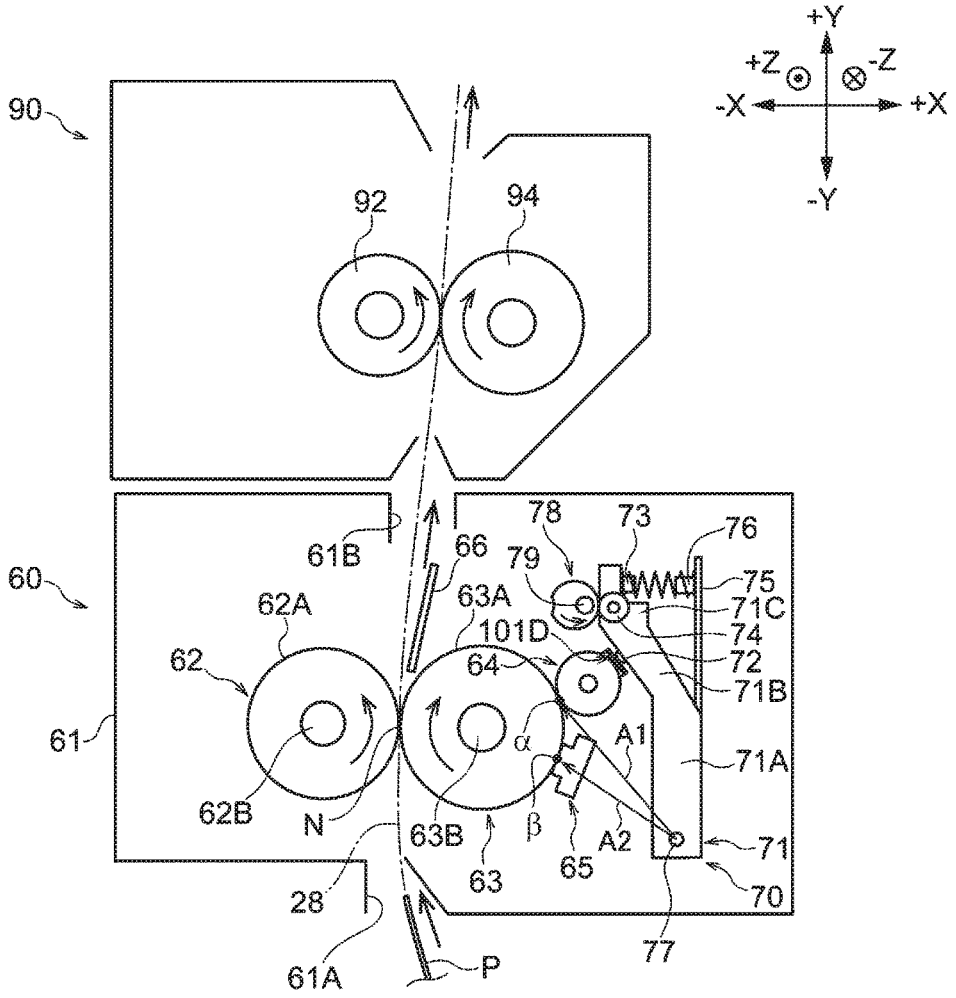
FIG. 10 is a front view of a fixing device and a decurler unit according to a modification of the first exemplary embodiment.

As illustrated in FIG. 10, compared with the first exemplary embodiment, the distance between the temperature controlling roller 64 and the temperature sensor 65 is short in the rotation direction of the heating roller 63 in the present modification. The temperature controlling roller 64 and the temperature sensor 65 are, however, disposed in such a manner that the distance A1 is longer than the distance A2, similarly to the first exemplary embodiment, in the present modification.

Second Exemplary Embodiment

The image forming apparatus 10 according to a second exemplary embodiment will be described below. In the description, features overlapping those in the first exemplary embodiment will be omitted.

Figure 11:
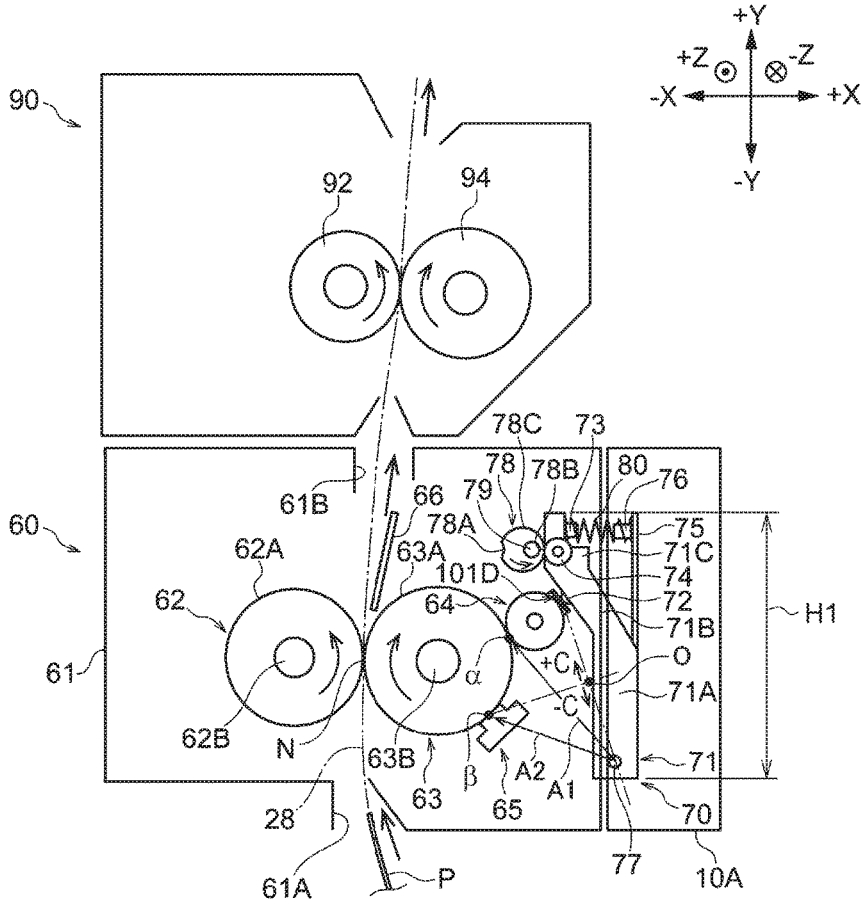
FIG. 11 is a front view of a fixing device and a decurler unit according to a second exemplary embodiment.

The fixing device 60 according to the second exemplary embodiment is attachable to and detachable from the image forming apparatus body 10A, similarly to the first exemplary embodiment. As illustrated in FIG. 11, the contact/separation mechanism 70 according to the second exemplary embodiment is supported by the image forming apparatus body 10A via a bracket (not shown) disposed on the image forming apparatus body 10A, differently from the first exemplary embodiment. Thus, the contact/separation mechanism 70 according to the second exemplary embodiment differs from that according to the first exemplary embodiment, in which the contact/separation mechanism 70 is supported by the housing 61 of the fixing device 60, in that the contact/separation mechanism 70 is supported by the image forming apparatus body 10A.

Here, in the second exemplary embodiment, the heating roller 63, the pressing roller 62, the temperature sensor 65, the temperature controlling roller 64, and the peeling member 66 are attached to the housing 61 because the contact/separation mechanism 70 is supported by the image forming apparatus body 10A. The pressing roller 62, the heating roller 63, and the temperature controlling roller 64 attached to the housing 61 are periodic replacement components, which will deteriorate over time as a result of use and thus are recommended to be replaced periodically.

Thus, it may be possible to attach and detach only the fixing device 60 including the aforementioned periodic replacement components to and from the image forming apparatus body 10A in the image forming apparatus 10 according to the second exemplary embodiment. In other words, it may be possible to replace the periodic replacement components without detaching the contact/separation mechanism 70, which does not correspond to a periodic replacement component, from the image forming apparatus body 10A in the image forming apparatus 10. Therefore, compared with a configuration in which the fixing device 60 and the contact/separation mechanism 70 are integral with each other, it may be possible to reduce the number of components to be replaced and to reduce running costs in the image forming apparatus 10.

In addition, the temperature controlling roller 64 of the image forming apparatus 10 according to the second exemplary embodiment is attachable to and detachable from the fixing device 60. In other words, it may be possible to selectively employ, for the fixing device 60 according to the second exemplary embodiment, either one of a configuration including the temperature controlling roller 64 and a configuration not including the temperature controlling roller 64, by attaching or detaching the temperature controlling roller 64 therefrom. Thus, it may be possible to select whether to attach the temperature controlling roller 64 to the fixing device 60 in the image forming apparatus 10 according to the second exemplary embodiment.

Modifications

In the aforementioned exemplary embodiments, the temperature controlling roller 64 is not caused to come into contact with the outer circumferential surface 63A of the heating roller 63 during each of the second and following rotations of the heating roller 63. The temperature controlling roller 64 is, however, not limited thereto and may be caused to come into contact with the outer circumferential surface 63A even during each of the second and following rotations of the heating roller 63 when the surface temperature of the heating roller 63 measured by the temperature sensor 65 is higher than the appropriate temperature.

The cam 78 is stopped at the first position, the second position, and the third position in the aforementioned exemplary embodiments. The cam 78 is, however, not limited thereto; the third position may be omitted, and the cam 78 may be stopped at the first position and the second position.

The temperature controlling roller 64 is a member that reduces the surface temperature of the heating roller 63 in the aforementioned exemplary embodiments. The temperature controlling roller 64 is, however, not limited thereto and may be a member that comes into contact with the outer circumferential surface 63A of the heating roller 63 and heats the heating roller 63 to increase the surface temperature of the heating roller 63.

The temperature controlling roller 64 includes the rubbing portion 64A that is formed on the outer circumferential surface thereof in the aforementioned exemplary embodiments. The temperature controlling roller 64 is, however, not limited thereto and may have a smooth outer circumferential surface without the formation of the rubbing portion 64A.

The pressing roller 62 includes the halogen heater (not shown) that serves as the heat source in the aforementioned exemplary embodiments. The pressing roller 62 is, however, not limited thereto and may not include the heat source.

The cam 78 rotates counter-clockwise in the view from the +Z side (front view) in the aforementioned exemplary embodiments. The cam 78 is, however, not limited thereto and may rotate clockwise in the view from +Z side (front view). In other words, the full-latch state may be caused by rotating the cam 78 clockwise in the view from the +Z side (front view).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating member that rotates around an axis thereof and that heats a developer image formed on a recording medium held by the heating member and a pressing member;

a controlling member that controls a surface temperature of the heating member by coming into contact with an outer circumferential surface of the heating member;

a measuring member that is positioned on a downstream side of the controlling member and on an upstream side of the pressing member in a rotation direction of the heating member and that measures the surface temperature of the heating member; and a supporting unit that causes the controlling member to come into contact with and be separated from the outer circumferential surface of the heating member by rotating a supporting member around a rotation fulcrum, wherein a distance between the rotation fulcrum and a contact position at which the controlling member comes into contact with the outer circumferential surface of the heating member is longer than a distance between the rotation fulcrum and a measurement position at which the measuring member measures the surface temperature of the heating member.

2. The fixing device according to claim 1, wherein the controlling member includes a rubbing portion that is formed on an outer circumferential surface of the controlling member and that controls surface roughness of the outer circumferential surface of the heating member by rubbing the outer circumferential surface of the heating member.

3. The fixing device according to claim 2, wherein the supporting unit includes a cam that causes the controlling member to come into contact with and be separated from the outer circumferential surface of the heating member by coming into contact with a portion of the supporting member and rotating, the portion being opposite to the rotation fulcrum with the controlling member interposed therebetween; and a driving unit that drives the cam to cause the cam to stop at a first position, a second position, and a third position, the first position being a position at which the controlling member comes into contact with the outer circumferential surface of the heating member, the second position being a position at which the controlling member is separated from the outer circumferential surface of the heating member, the third position being between the first position and the second position.

4. The fixing device according to claim 3, wherein the rotation fulcrum is spaced apart from the contact position and opposite the contact position with respect to the measurement position in an intersection direction intersecting an axial direction of the heating member.

5. The fixing device according to claim 1, wherein the supporting unit includes a cam that causes the controlling member to come into contact with and be separated from the outer circumferential surface of the heating member by coming into contact with a portion of the supporting member and rotating, the portion being opposite to the rotation fulcrum with the controlling member interposed therebetween; and a driving unit that drives the cam to cause the cam to stop at a first position, a second position, and a third position, the first position being a position at which the controlling member comes into contact with the outer circumferential surface of the heating member, the second position being a position at which the controlling member is separated from the outer circumferential surface of the heating member, the third position being between the first position and the second position.

6. The fixing device according to claim 5, wherein the rotation fulcrum is spaced apart from the contact position and opposite the contact position with respect to the measurement position in an intersection direction intersecting an axial direction of the heating member.

7. An image forming apparatus comprising:

an image carrier;

a charging unit that charges the image carrier;

an exposure unit that exposes the image carrier charged by the charging unit to light to form a latent image onto the image carrier;

a developing unit that develops, by using a developer, the latent image formed by the exposure unit, thereby forming a developer image;

a transfer unit that transfers the developer image formed by the developing unit onto a recording medium; and the fixing device according to claim 1 that fixes the developer image transferred by the transfer unit to the recording medium.

8. An image forming apparatus comprising:

a fixing device including a heating member that rotates around an axis thereof and that heats a developer image formed on a recording medium held by the heating member and a pressing member, a controlling member that controls a surface temperature of the heating member by coming into contact with an outer circumferential surface of the heating member, and a measuring member that is positioned on a downstream side of the controlling member and on an upstream side of the pressing member in a rotation direction of the heating member and that measures the surface temperature of the heating member;

an image forming apparatus body to which the fixing device is detachably attached; and a supporting unit that is disposed in the image forming apparatus body and that causes the controlling member to come into contact with and be separated from the outer circumferential surface of the heating member by rotating a supporting member around a rotation fulcrum, wherein a distance between the rotation fulcrum and a contact position at which the controlling member comes into contact with the outer circumferential surface of the heating member is longer than a distance between the rotation fulcrum and a measurement position at which the measuring member measures the surface temperature of the heating member.

9. The image forming apparatus according to claim 8, wherein the controlling member is attachable to and detachable from the fixing device.

* * * * *